United States Patent [19]

Rutz

[11] 3,968,734

[45] July 13, 1976

[54] HYDROSTATIC PISTON MACHINE

[75] Inventor: Peter Rutz, Winterthur, Switzerland

[73] Assignee: Sulzer Brothers Limited, Winterthur, Switzerland

[22] Filed: Oct. 10, 1974

[21] Appl. No.: 513,749

[30] Foreign Application Priority Data

Oct. 15, 1973 Switzerland ..... 14585/73

[52] U.S. Cl. ..... 91/491; 91/498

[51] Int. Cl.[2] ..... F01B 13/06

[58] Field of Search ..... 91/491–498

[56] References Cited

UNITED STATES PATENTS

| | | | |
|---|---|---|---|
| 3,148,627 | 9/1964 | Muller | 91/494 |
| 3,709,104 | 1/1973 | Culberson | 91/495 |
| 3,744,380 | 7/1973 | Steiger | 91/488 |
| 3,777,624 | 12/1973 | Dixon | 91/488 |
| 3,785,250 | 1/1974 | Steiger | 91/491 |

*Primary Examiner*—William L. Freeh
*Attorney, Agent, or Firm*—Kenyon & Kenyon Reilly Carr & Chapin

[57] ABSTRACT

The guide member for the pistons is made of a guide ring and a pair of disc-shaped side parts. The mating bearing surfaces of the guide ring and each side part are disposed about a plane of symmetry which is coincident with the plane of symmetry of the bearing surface of side part on the pin. This avoids deformation of the guide member under high radial loads.

4 Claims, 4 Drawing Figures

HYDROSTATIC PISTON MACHINE

This invention relates to a hydrostatic piston machine.

Hydrostatic piston machines have been known in which a cylinder block is rotatably mounted about a pin or pivot and in which pistons are guided. The pistons are usually distributed radially of the pin at the periphery of the cylinder block and, at their outer ends, have feet with plane bearing surfaces guided along plane guide surfaces of a guide member. The guide surfaces is usually disposed tangentially with respect to a circular cylindrical surface which is eccentric of the cylinder block axis, the guide member being mounted on the pin so as to rotate about the axis of the circular cylindrical surface. A piston machine of this kind is known, for example, from German Offenlegungsschrift 2,134,944. However, in a machine of this type, the guide member is subjected to considerable radial forces so that a hydrostatic mounting must be provided on the pin or pivot. In addition, there may be a considerable amount of oil loss.

Accordingly, it is an object of the invention to provide a piston machine of the above kind in which the guide member is constructed to be mounted on the pin or pivot with minimum play and without the risk of jamming.

It is another object of the invention to minimize oil losses in hydrostatic piston machines.

It is another object of the invention to obtain a high operating efficiency in a hydrostatic piston machine.

Briefly, the invention provides a hydrostatic piston machine which has a pin, a cylinder block rotatably mounted on the pin, a plurality of pistons which are movably mounted in the cylinder block radially of the pin and a guide member rotatably mounted on the pin to obviate deformation of the guide member on the pin. The pistons each have a foot at an outer end with a plane bearing surface disposed tangentially of a circular cylinder having an axis eccentrically disposed relative to the axis of the cylinder block. The guide member includes a guide ring and a pair of disc-shaped side parts supporting the guide ring in a radial direction. The guide ring has guide surfaces for guiding the bearing surfaces of the feet of the pistons as well as a cylindrical bearing surface at each lateral end. Each side part has a cylindrical bearing surface bearing against a bearing surface of the guide ring as well as a bearing surface of the pin. The cylindrical bearing surfaces of the guide ring and each side part have a plane of symmetry perpendicular to the axis of the pin and coincident with a plane of symmetry of the bearing surface of the side part facing the pin.

Since the planes of symmetry of the bearing surfaces of each side part of the guide member are coincident, even in the event of very high radial loads on the guide ring, any deformation of the bearing surfaces on the pin which might cause jamming can be avoided. As a result, an extremely small clearance can be used between the pin and the bearing surface in the side part so that oil losses in the hydrostatic bearing can be minimized. Thus, in addition to achieving operating reliability, a very high efficiency of the machine can be obtained.

The bearing surfaces may form lateral shoulders on the guide ring and the shoulders can be situated in the zone of the neutral axis of the cross-section of the guide ring. In addition, the bearing surfaces of the side parts can be formed in laterally bent edge zones which are offset from the planes of symmetry of the bearings of the side parts. This gives a simple mechanical embodiment in which the piston bearing surfaces may, if required, be wider than the axial length of the cylinder block.

Screw bolts may be used to connect the side parts to the guide ring. In such a case, each bolt passes through a bore in the guide ring of a larger diameter than the diameter of the bolt shank. Thus, in the event of deformation of the guide ring in an axial direction under the influence of the piston forces, the bolt shank remains out of contact with the wall of the bore.

These and other objects and advantages of the invention will become more apparent from the following detailed description and appended claims taken in conjunction with the accompanying drawings in which:

FIG. 1 diagrammatically illustrates an axial section of a piston machine according to the invention;

Figure 1:
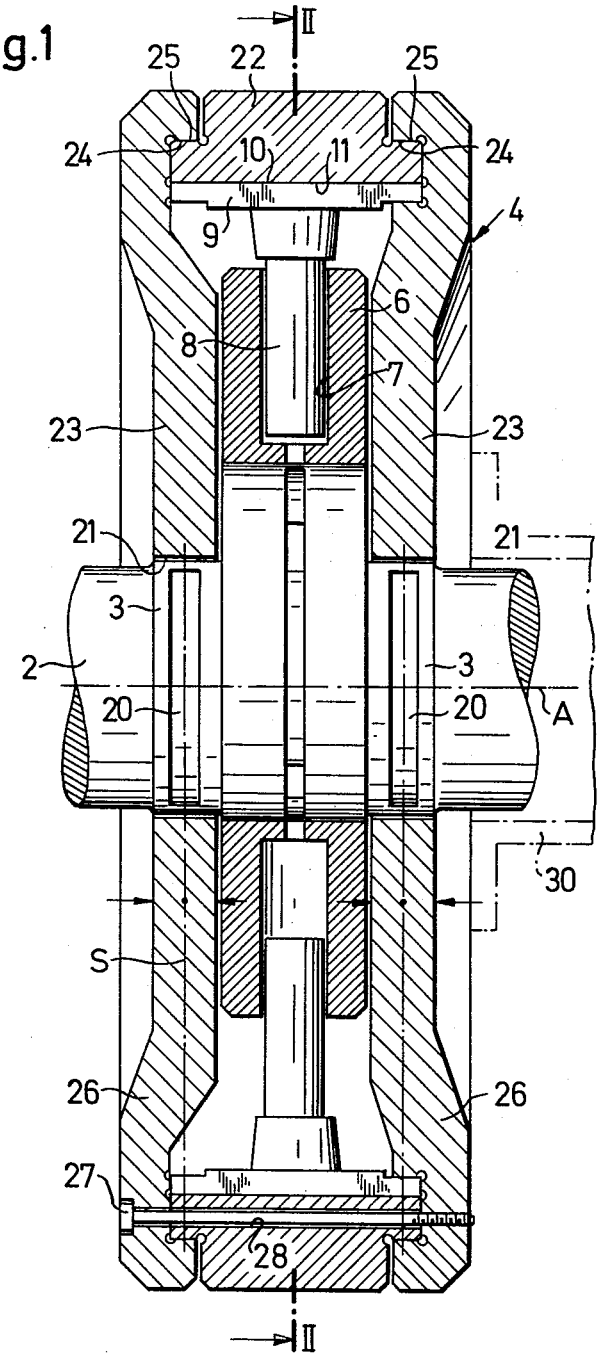

Referring to FIG. 1, the hydrostatic piston machine includes a pin or pivot 2 secured in a machine housing (not shown). The pin 2 has cylindrical surfaces 3 for rotatably mounting a guide member 4 about an axis A and a cylindrical surface 5 eccentric thereof for rotatably mounting a cylinder block 6 about an eccentric axis. Cylinder bores 7 are formed in the cylinder block 6 to receive and guide pistons 8 radially with respect to the cylindrical surface 5 of the pin 2. The pistons 8 each have feet 9 with plane bearing surfaces 10 which bear on plane guide surfaces 11 of the guide member 4.

Figure 2:
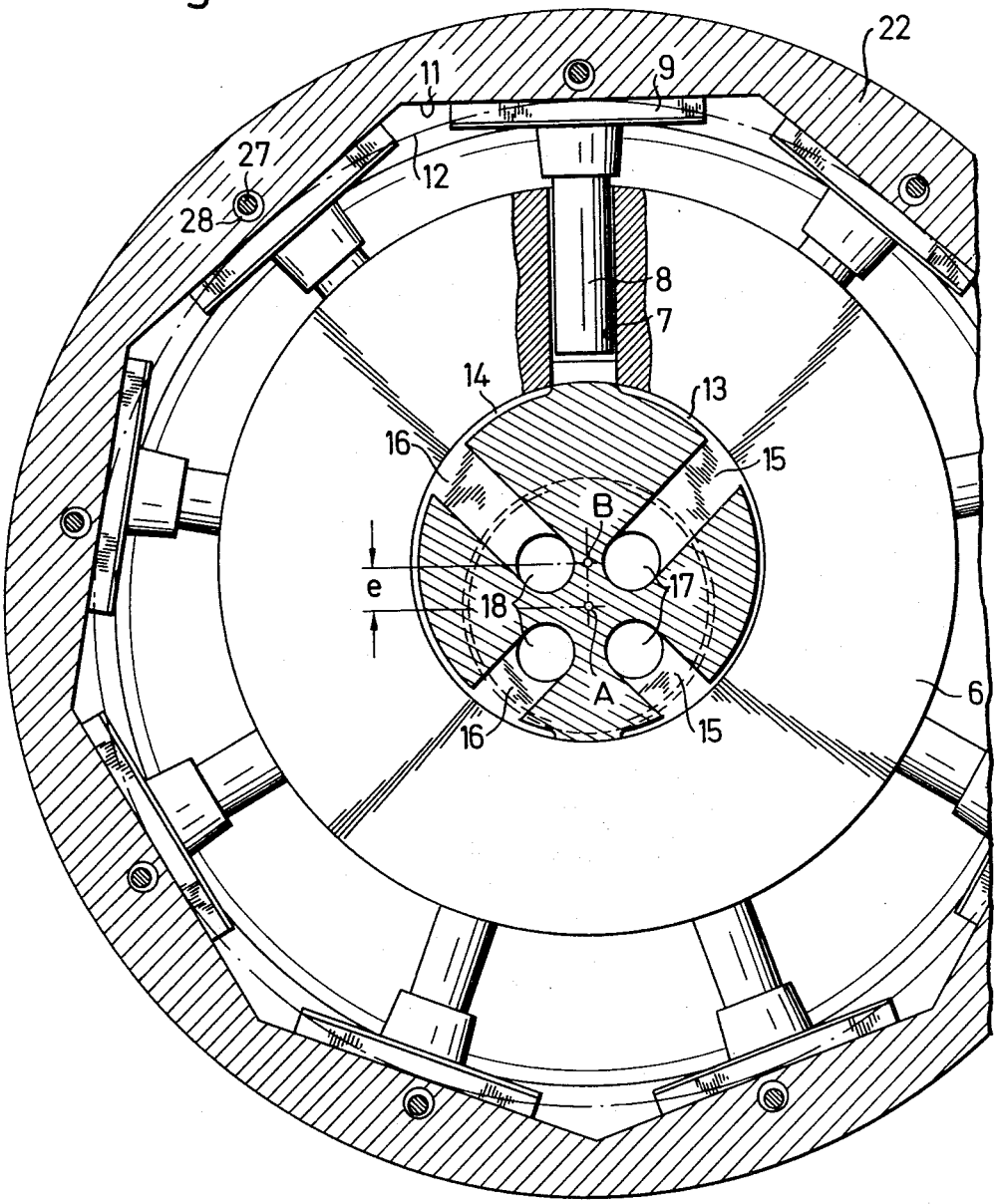
FIG. 2 illustrates a view taken on line II—II of FIG. 1.

Referring to FIG. 2, the guide surfaces 11 are disposed tangentially to a circular cylinder 12, the axis of which lies on the axis A of the cylindrical surfaces 3 and pin 2. As shown, axis A is offset from axis B of the cylindrical surface 5 of the pin 2 and the cylinder block 6 by an eccentricity *e*.

Control ducts 13, 14 are formed in the part of the pin 2 having the cylindrical surface 5 and communicate via connecting ducts 15, 16 with ducts 17, 18 for the supply and discharge of hydraulic pressure medium as is known. The cylindrical surfaces 3 of the pin 2 are provided with hydrostatic bearing pockets 20 which are connected to the ducts 17, 18 in known manner (not shown). As described in the German Offenlegungsschrift 2,134,944, the connection of the bearing pockets 20 to the ducts 17 or 18 gives a bearing system in which forces are exerted on the bearing surfaces 21 of the guide member to keep the forces exerted by the pistons 8 on the guide member 4 in equilibrium.

Referring to FIG. 1, the guide member 4 is divided up into a guide ring 22 and two side parts 23. The side parts 23 have bearing surfaces 21 facing the cylindrical surfaces 3 of the pin 2 and as well as cylindrical surfaces 24 which bear against cylindrical surfaces 25 of the guide ring 22. The arrangement is such that a plane of symmetry S of the surfaces 24, 25 perpendicular to the axis A of the guide member 4 simultaneously forms or coincides with the plane of symmetry of the bearing surface 21 perpendicular to the axis of the guide member 4. As will be apparent from FIG. 1, the bearing surfaces 25 on the guide ring 22 form lateral shoulders situated near the neutral axis X of the cross-section of the guide ring 22. The bearing surfaces 24 of the side parts 23 are formed in laterally bent edge zones 26 which are offset from the planes of symmetry S of the bearing surfaces 21 of the side parts 23.

Figure 3:
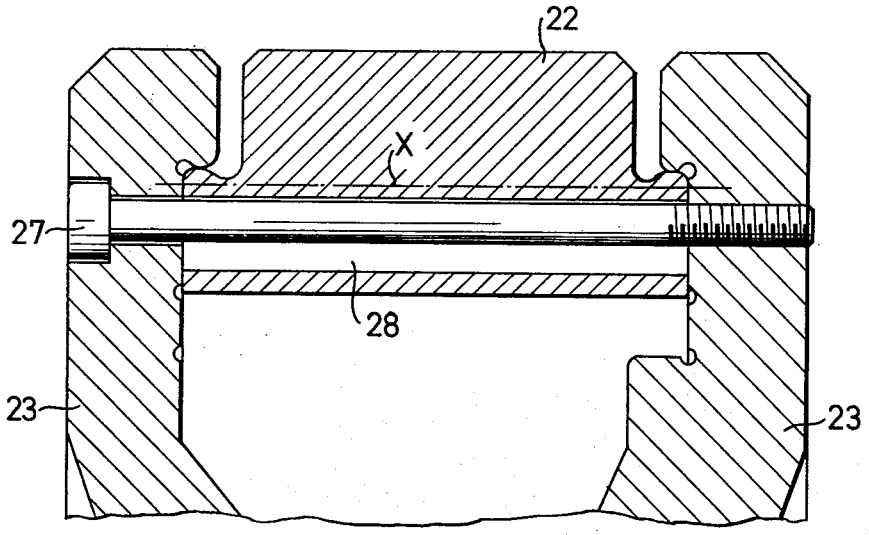
FIG. 3 illustrates a detail of FIG. 1 of the guide ring to an enlarged scale and in the non-deformed state.
Figure 4:
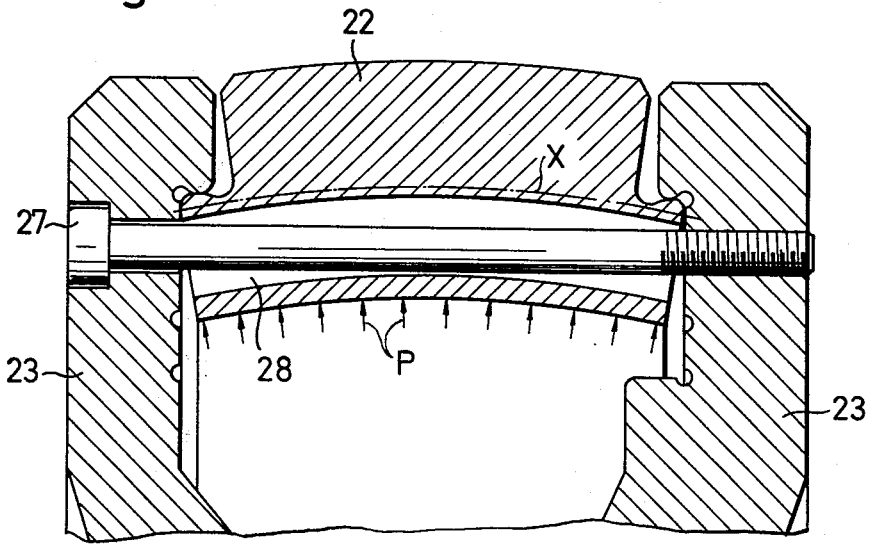
FIG. 4 illustrates a detail corresponding to FIG. 3 but with the guide ring deformed due to the contact pressure force of one of the pistons.

Referring to FIGS. 1, 3 and 4, bolts 27 are provided to connect the side parts 23 to the guide ring 22 and pass through bores 28 in the guide ring 22. The diameter of each bore 28 is larger than that of a respective bolt shank so that, in the event of deformation of the guide ring 22 in its axial direction as shown in FIG. 4 under the influence of the piston forces (P in FIG. 4), the shank of the bolt 27 remains out of contact with the wall of the bore 28.

Since the planes of symmetry of the bearing surfaces 24 also form the planes of symmetry of the bearing surfaces 21, any deformation of the bearing surface 21 in the axial direction such as might lead to edge compression is avoided. In this embodiment, there is only a symmetrical loading in the wall of the side part 23 in the zone of the bearing surface 21 so that the bearing surface 21 is pressed uniformly in the axial direction over its entire length against the pin 2.

Referring to FIGS. 3 and 4, the construction of the guide member 4 also prevents bending moments due to loading of the guide surfaces 11 from being transmitted to the side parts. Referring to FIG. 4, the forces P produced by the pistons 8 result only in deformation of the guide ring 22 in its axial direction at the place in question without such deformation being transmitted as a bending moment to the side parts 23. This also obviates deformation of the side parts 23 with the possibility of the bearing surfaces 21 jamming on the surfaces 3 of the pin 2.

As shown in FIG. 1, a hollow shaft 30 can be used, for example, for connecting a motor when the machine is used as a pump. Of course, the guide member 4 may be connected in some other way.

The bearing surfaces 24 and 25 are so shown in FIG. 1 as to have a common plane of symmetry S. However, if these surfaces are laterally offset from one another, the plane of symmetry of S must be the plane of symmetry of that operative part of these surfaces at which they bear on one another.

What is claimed is:

1. A hydrostatic piston machine comprising a pin;

a cylinder block rotatably mounted on said pin about an axis;

a plurality of pistons movably mounted in said cylinder block radially of said pin, each said piston having a foot at an outer end, said foot having a plane bearing surface thereon disposed tangentially of a circular cylinder having an axis eccentrically disposed relative to said axis of said cylinder block; and a guide member rotatably mounted on said pin to rotate about said axis of said cylinder, said guide member including a guide ring having guide surfaces guiding each said bearing surface of a respective foot and a cylindrical bearing surface at each lateral end, and a pair of disc-shaped side parts supporting said guide ring in a radial direction, each said part having a cylindrical bearing surface bearing against a bearing surface of said guide ring and a bearing surface facing said pin, said cylindrical bearing surfaces of said guide ring and one of said parts having a plane of symmetry perpendicular to said cylinder axis and coincident with a plane of symmetry of said bearing surface of said side part facing said pin.

2. A machine as set forth in claim 1 wherein said cylindrical bearing surfaces of said guide ring form lateral shoulders in the zone of the neutral axis of said guide ring, and said cylindrical bearing surfaces of each said side part are in laterally bent edge zones of said parts, said zones being offset from said plane of symmetry.

3. A machine as set forth in claim 1 wherein said guide ring has a plurality of bores therein and which further comprises screw bolts, each said bolt passing through a respective bore and having a shank of a diameter less than the diameter of a bore to permit deflection of said guide ring under a piston force without contacting said guide ring.

4. A hydrostatic piston machine having a pin mounted on a first axis;

a cylinder block rotatably mounted on said pin about a second axis eccentric to said first axis;

a plurality of pistons movably mounted in said cylinder block radially of said pin, each piston having a foot including a plane bearing surface disposed tangentially of a circular cylinder disposed coaxially of said first axis; and a guide member rotatably mounted on said pin coaxially of said first axis, said guide member including a guide ring having guide surfaces guiding each said bearing surface of a respective foot and a cylindrical bearing surface at each lateral end, and a pair of disc-shaped side parts supporting said guide ring in a radial direction, each said part having a cylindrical bearing surface facing a bearing surface of said guide ring about a plane of symmetry perpendicular to said first axis and a bearing surface facing said pin about a plane of symmetry coincident with said first plane of symmetry.

* * * * *